US009554610B2

(12) United States Patent
Sugerman et al.

(10) Patent No.: US 9,554,610 B2
(45) Date of Patent: Jan. 31, 2017

(54) PROTECTIVE HEADGEAR ASSEMBLY

(71) Applicant: Honeywell International Inc., Morristown, NJ (US)

(72) Inventors: Jonathan Sugerman, Cranston, RI (US); Joseph Rodrigues, Cranston, RI (US); Jacky Zhu, Shanghai (CN); Oliver Li, Shanghai (CN)

(73) Assignee: Honeywell International, Inc., Morris Plains, NJ (US)

( * ) Notice: Subject to any disclaimer, the term of this patent is extended or adjusted under 35 U.S.C. 154(b) by 634 days.

(21) Appl. No.: 14/014,873

(22) Filed: Aug. 30, 2013

(65) Prior Publication Data

US 2014/0101828 A1 Apr. 17, 2014

Related U.S. Application Data

(60) Provisional application No. 61/712,797, filed on Oct. 11, 2012.

(51) Int. Cl.
*A42B 3/08* (2006.01)
*A42B 3/14* (2006.01)

(52) U.S. Cl.
CPC ..... *A42B 3/085* (2013.01); *A42B 3/145* (2013.01)

(58) Field of Classification Search
CPC ..... A42B 3/085; A42B 3/145; A42B 3/14; A42B 3/142; A42B 3/147
USPC ..... 2/411, 416, 417, 418, 419, 420, 421
See application file for complete search history.

(56) References Cited

U.S. PATENT DOCUMENTS 3,383,705 A * 5/1968 Raschke ..... A42B 3/14 2/181.4
3,388,405 A * 6/1968 Simpson ..... A42B 3/14 2/418
3,430,260 A * 3/1969 Stropkay ..... A42B 3/14 2/416
3,510,879 A * 5/1970 Webb ..... A42B 3/14 2/416
3,555,560 A * 1/1971 Rascke ..... A42B 3/14 2/416
3,633,214 A * 1/1972 Newcomb ..... A42B 3/14 2/418
3,852,821 A * 12/1974 Mickel ..... A42B 3/142 2/415
4,263,679 A * 4/1981 Erlendson ..... A42B 3/142 2/420

(Continued)

*Primary Examiner* — Alissa L Hoey
(74) *Attorney, Agent, or Firm* — Craige Thompson; Thompson Patent Law

(57) ABSTRACT

Apparatus and associated methods may relate to a protective headgear assembly having a suspension system with user controls for independently adjusting a front loop length and an occipital loop length. In an illustrative example, the front loop length may lie in a substantially horizontal plane, and the occipital loop length may lie substantially in a plane that intersects the front loop length at non-zero angle such that the occipital loop length descends posterior a user ear to cradle a user occipital. In some examples, an intersection of the front loop length and the occipital loop length may fit proximal the user ear after adjusting the frontal loop length and the occipital loop length to circumferentially fit a user head. In some examples, the user control for the front length may provide a macro adjustment and the user control for the occipital length may provide a micro adjustment.

7 Claims, 11 Drawing Sheets

(56) References Cited

U.S. PATENT DOCUMENTS 4,293,960 A * 10/1981 Palmaer ..... A42B 3/14 2/416
4,942,628 A * 7/1990 Freund ..... A42B 3/145 2/410
5,044,019 A * 9/1991 Shewchenko ..... A42B 3/14 2/416
5,077,836 A * 1/1992 Idoff ..... A61F 9/04 2/10
5,571,217 A * 11/1996 Del Bon ..... A42B 3/14 2/8.1
5,608,917 A * 3/1997 Landis ..... A42B 3/14 2/11
5,619,754 A * 4/1997 Thurwanger ..... A42B 3/085 2/416
5,898,949 A * 5/1999 Barthold ..... A42B 3/14 2/411
6,032,297 A * 3/2000 Barthold ..... A42B 3/10 2/416
6,081,931 A * 7/2000 Burns ..... A42B 3/14 2/411
6,760,927 B2 * 7/2004 Guay ..... A42B 3/145 2/418
6,862,747 B2 * 3/2005 Oleson ..... A42B 3/14 2/416
7,120,939 B1 * 10/2006 Howard ..... A42B 3/14 2/416
8,510,870 B2 * 8/2013 Rogers ..... A42B 3/324 2/417
8,584,265 B2 * 11/2013 Lilenthal ..... A42B 3/14 2/417
8,875,318 B2 * 11/2014 Huh ..... A42B 3/145 2/416
2002/0000004 A1 * 1/2002 Wise ..... A42B 3/14 2/416
2002/0112277 A1 * 8/2002 Musal ..... A42B 3/14 2/418
2004/0093660 A1 * 5/2004 Bostock ..... A42B 1/08 2/416
2004/0255370 A1 * 12/2004 Moeller ..... A42B 3/145 2/416
2005/0138719 A1 * 6/2005 Huh ..... A42B 3/14 2/416
2005/0217006 A1 * 10/2005 Sutter ..... A42B 3/06 2/416
2006/0048285 A1 * 3/2006 Bielefeld ..... A42B 3/145 2/416
2009/0320187 A1 * 12/2009 Petzl ..... A42B 3/14 2/417
2010/0050325 A1 * 3/2010 Wang-Lee ..... A42B 3/145 2/418
2010/0113991 A1 * 5/2010 Wu ..... A61H 7/006 601/46
2010/0229274 A1 * 9/2010 Ahlgren ..... A42B 3/225 2/8.2
2010/0229286 A1 * 9/2010 Ahlgren ..... A42B 3/142 2/416
2011/0167542 A1 * 7/2011 Bayne ..... A42B 3/14 2/416
2013/0205477 A1 * 8/2013 Pfanner ..... A42B 3/166 2/416
2014/0109301 A1 * 4/2014 Hall ..... A42B 3/142 2/416

* cited by examiner

PROTECTIVE HEADGEAR ASSEMBLY

CROSS-REFERENCE TO RELATED APPLICATIONS

This application claims the benefit under Title 35, United States Code, Section 119(e) of United States provisional patent application entitled "Protective Headgear Assembly," Ser. No. 61/712,797, which was filed on Oct. 11, 2012. The 61/712,797 application is hereby incorporated by reference into this application.

TECHNICAL FIELD

Various embodiments relate generally to head protective apparel, such as a hard hat, and more particularly to a protective headgear for providing a more comfortable, safe, and secure fit upon a user's head.

BACKGROUND

Common practice in the construction trade and certain other industries requires the use of a protective headgear or "hard hats" by workers entering or performing work in hazardous areas. The protective headgear is designed to prevent head injuries to the wearer, while still permitting the wearer to perform necessary job functions or duties. Because of its wide application and acceptance, protective headgear must generally be constructed in a manner which permits sizing the protective headgear to many different head shapes and sizes.

Prior protective headgear may not be entirely satisfactory, for example the protective headgear may not maintain a comfortable balance upon certain user's heads due in part to the size or shape of user's head. In cases where the protective headgear does not maintain a proper or comfortable balance upon the user's head, the protective headgear may be a distraction to the user which may cause an unsafe work environment for the user and others. Other configurations of protective headgear may not provide adequate protection to the user, thus leaving portions of the user's head or neck exposed to hazardous objects.

SUMMARY

Apparatus and associated methods may relate to a protective headgear assembly having a suspension system with user controls for independently adjusting a front loop length and an occipital loop length. In an illustrative example, the front loop length may lie in a substantially horizontal plane, and the occipital loop length may lie substantially in a plane that intersects the front loop length at a non-zero angle such that the occipital loop length descends posterior a user ear to cradle a user occipital. In some examples, an intersection of the front loop length and the occipital loop length may fit proximal the user ear after adjusting the frontal loop length and the occipital loop length to circumferentially fit a user head. In some examples, the user control for the front length may provide a macro adjustment and the user control for the occipital length may provide a micro adjustment.

In some examples, various embodiments may provide an inner headband for permitting diametric adjustments of the suspension system via both macro and micro adjustments. For example, the suspension system may include a two-piece inner headband having a first portion configured for macro adjustments and a separate second portion configured for micro adjustments. The first portion may include a raised member which mates with one of a series of apertures, for example. The second portion may include a ratchet assembly configured for longitudinally adjusting ends of the inner headband, for example. In some embodiments, the first portion may be located at a front of the inner headband and the second portion may be located at a rear of the inner headband. In an illustrative example, the inner headband attaches to a hanger assembly in a way that enables a user to center the headgear shell upon the head. The shell may be configured to fit on a human head, for example.

In another illustrated example, the protective headgear assembly may provide a lower extended portion extending from the headgear shell to provide a protective barrier to the lower head or neck portion of a user. In an illustrative example, the lower extended portion extends from a rear of the headgear shell to provide a protective barrier to the nape region of the user. In some examples, the lower extended portion may be integrally formed with the headgear shell. In an illustrative example, a rear-impact attenuator may line an interior surface of the lower extended portion to absorb energy resulting from an external impact force contacting the lower extended portion. In some examples, a suspension system may provide securement of the rear-impact attenuator to the headgear shell. For example, the rear-impact attenuator may include a central opening for receiving an interlocking structure formed by the suspension system and the headgear shell.

Various embodiments may achieve one or more advantages. For example, some embodiments may ensure the protective headgear is centered upon the user's head during and after any diametric adjustments. In an illustrative example, a hanger assembly may independently center the inner headband with respect to the headgear shell via one or more inwardly extending projections. The inwardly extending projections of the hanger assembly may provide an interface between the inner headband and the headgear shell, for example. In an illustrative example, the hanger assembly may include one or more fixed attachment projections and one or more movable attachment projections for attachment to the inner headband. The movable attachment projections may automatically adjust depending upon the diametric setting of the inner headband, while the fixed attachment projections of the hanger assembly may maintain a spatially fixed attachment to the inner headband. In some illustrative embodiments, the fixed attachment points may provide a minimum separation distance between the user's head and the headgear shell.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 3:
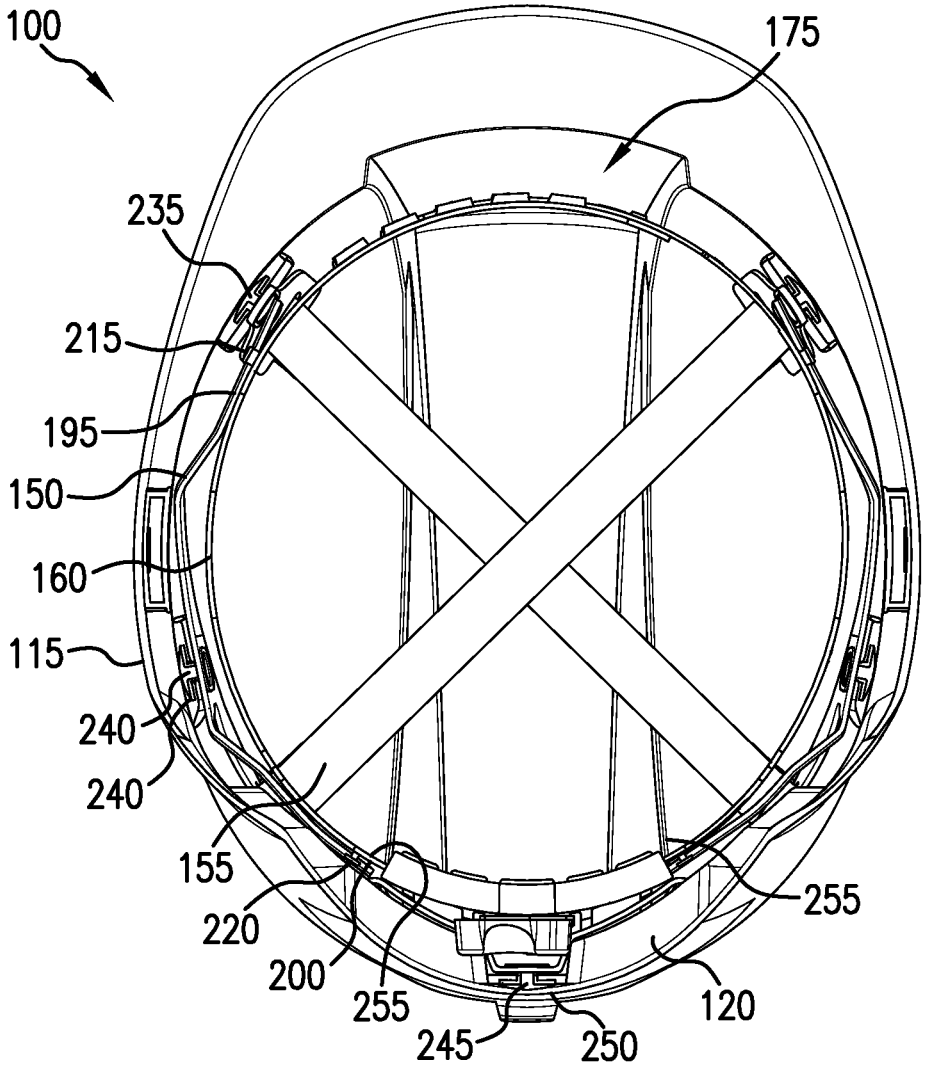
FIG. 3 depicts a bottom view of an exemplary protective headgear assembly with the inner headband in a first diametric position.
Figure 4:
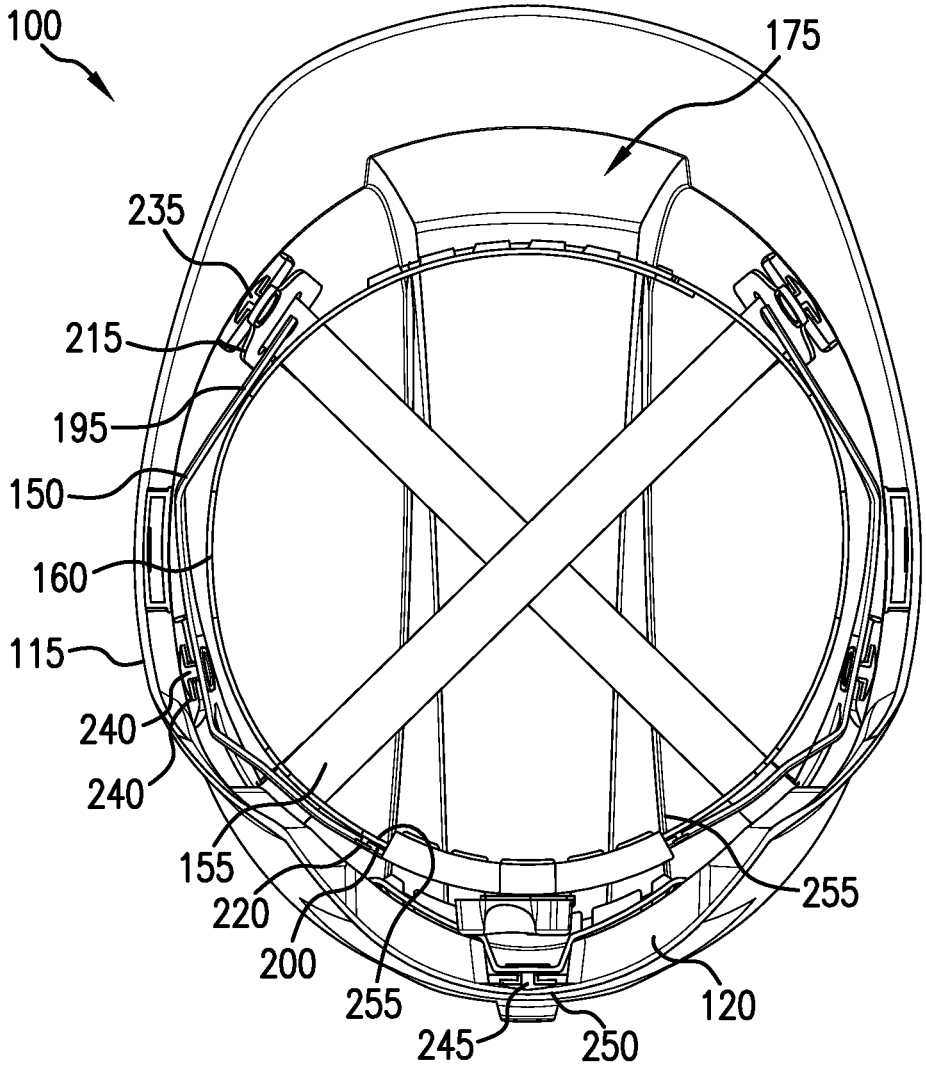
FIG. 4 depicts a bottom view of an exemplary protective headgear assembly with the inner headband in a second diametric position.

To aid understanding, this document is organized as follows. First, a protective headgear assembly is briefly introduced with reference to FIG. 1, the protective headgear assembly being circumferentially fitted to a head of a user. Second, with reference to FIG. 2, the discussion turns to exemplify individual components of the protective headgear assembly in an exploded manner. Then, the discussion turns to exemplary embodiments that illustrate a diametrically adjustable inner headband of the protective headgear assembly and spatial relationship to a shell of the protective headgear assembly. Specifically, FIG. 3 illustrates the inner headband in a first diametric position, and FIG. 4 illustrates the inner headband in a second diametric position, where the inner headband maintains a similar spatial relationship to the shell in both the first and second diametric positions.

Figure 5:
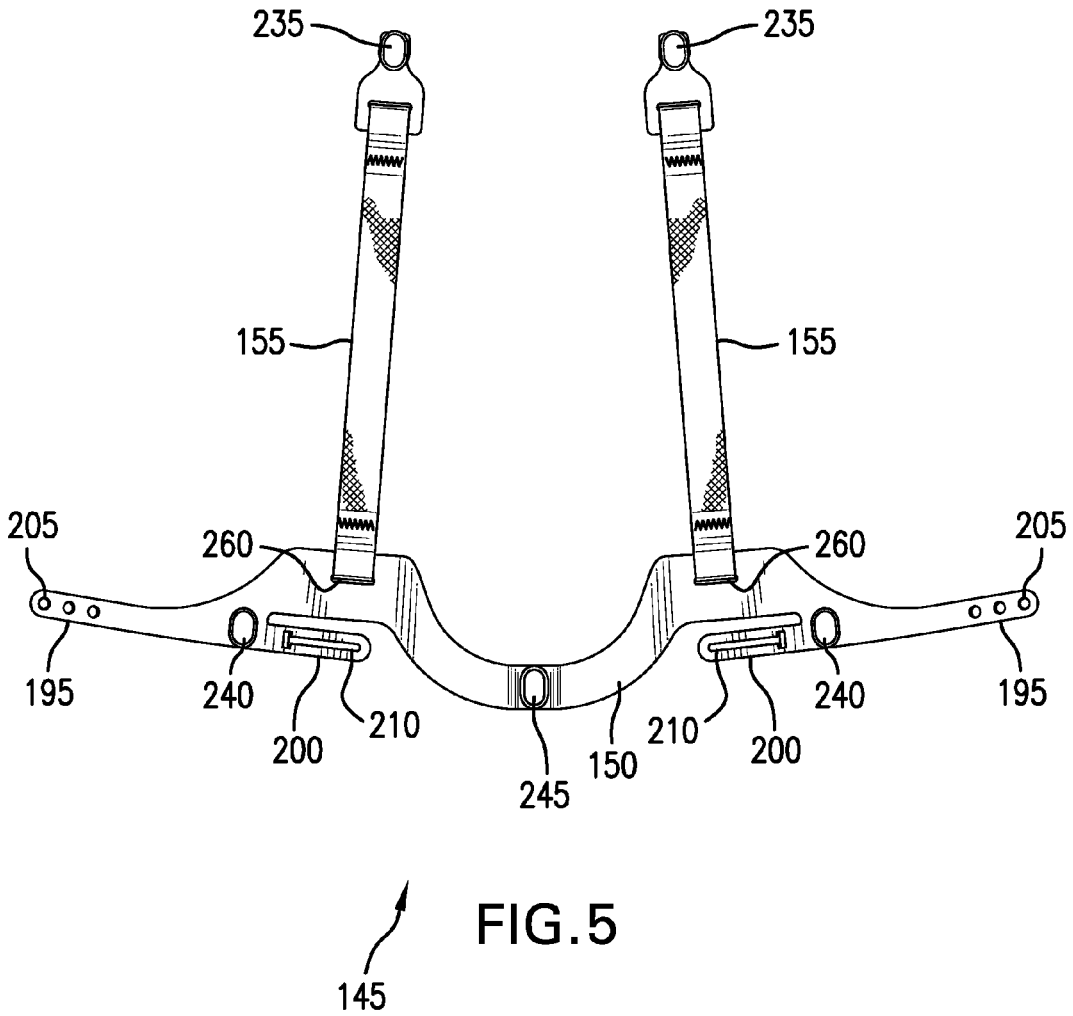
FIG. 5 depicts an exemplary hanger assembly.
Figure 6:
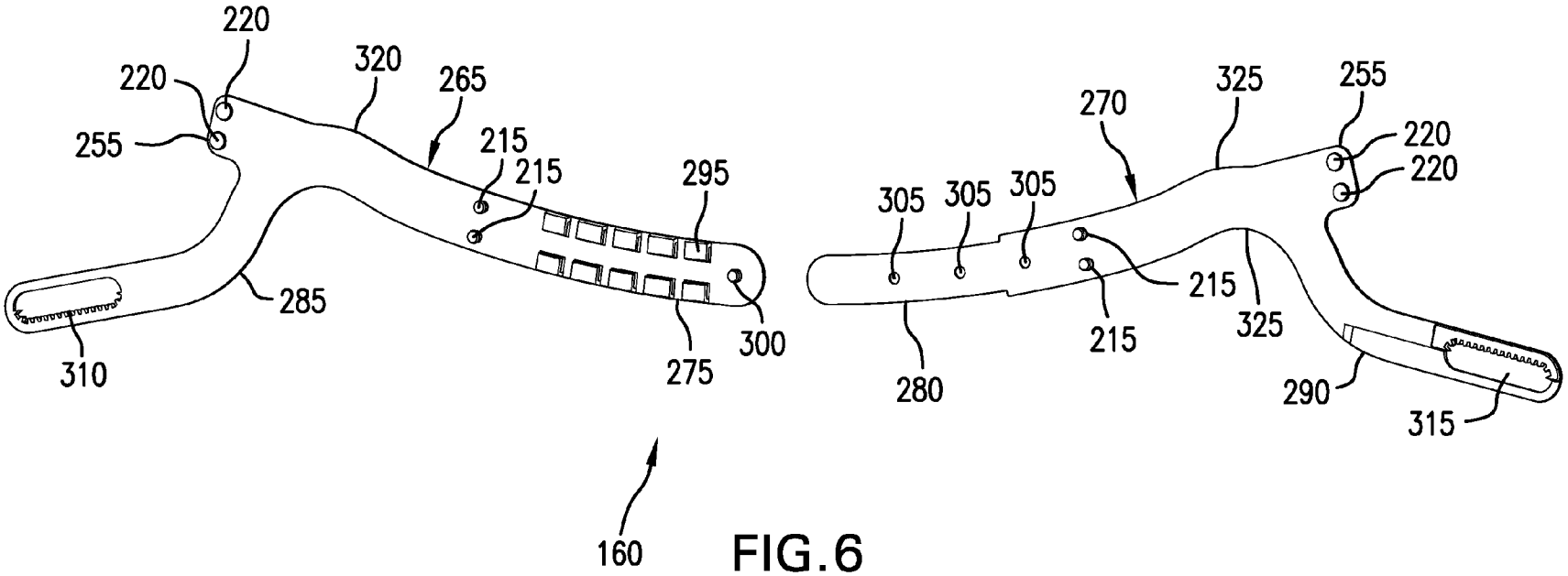
FIG. 6 depicts an exemplary inner headband in a disconnected state.
Figure 7:
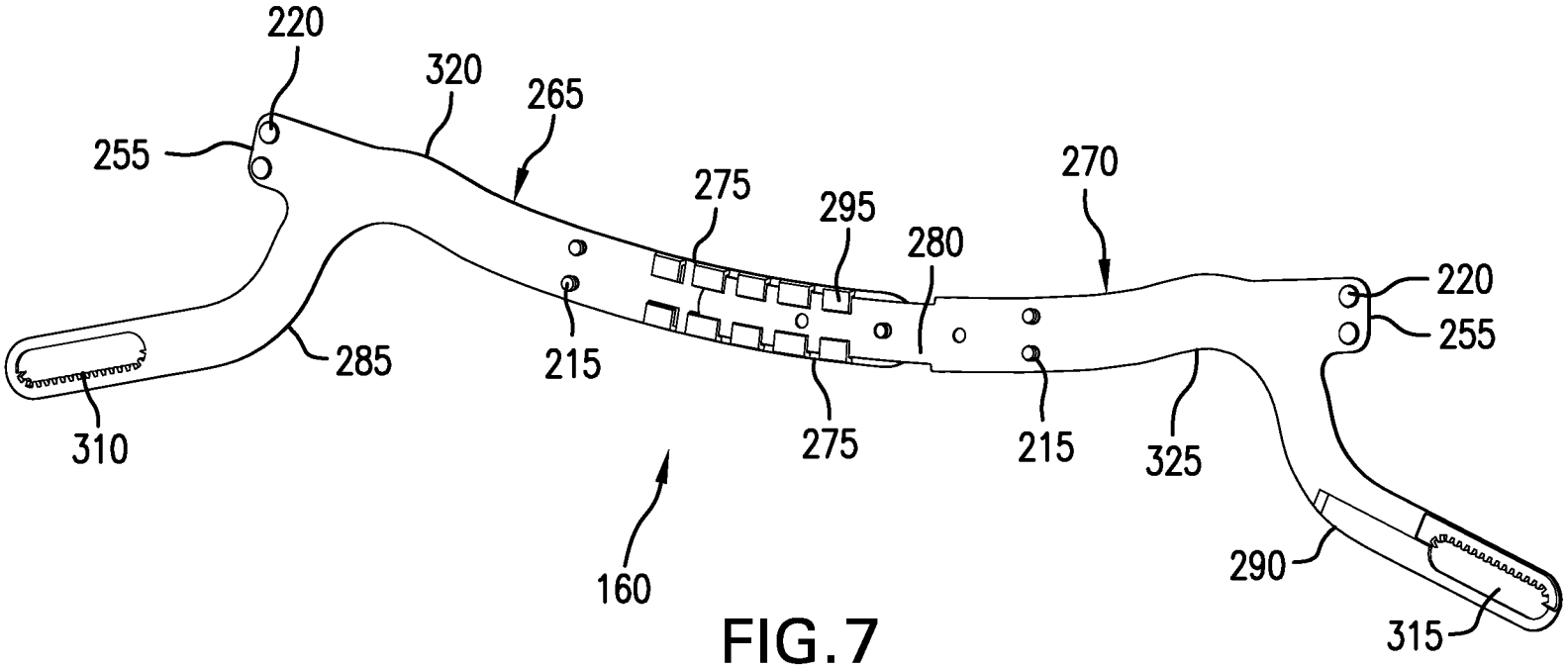
FIG. 7 depicts an exemplary inner headband in a connected state.
Figure 8:
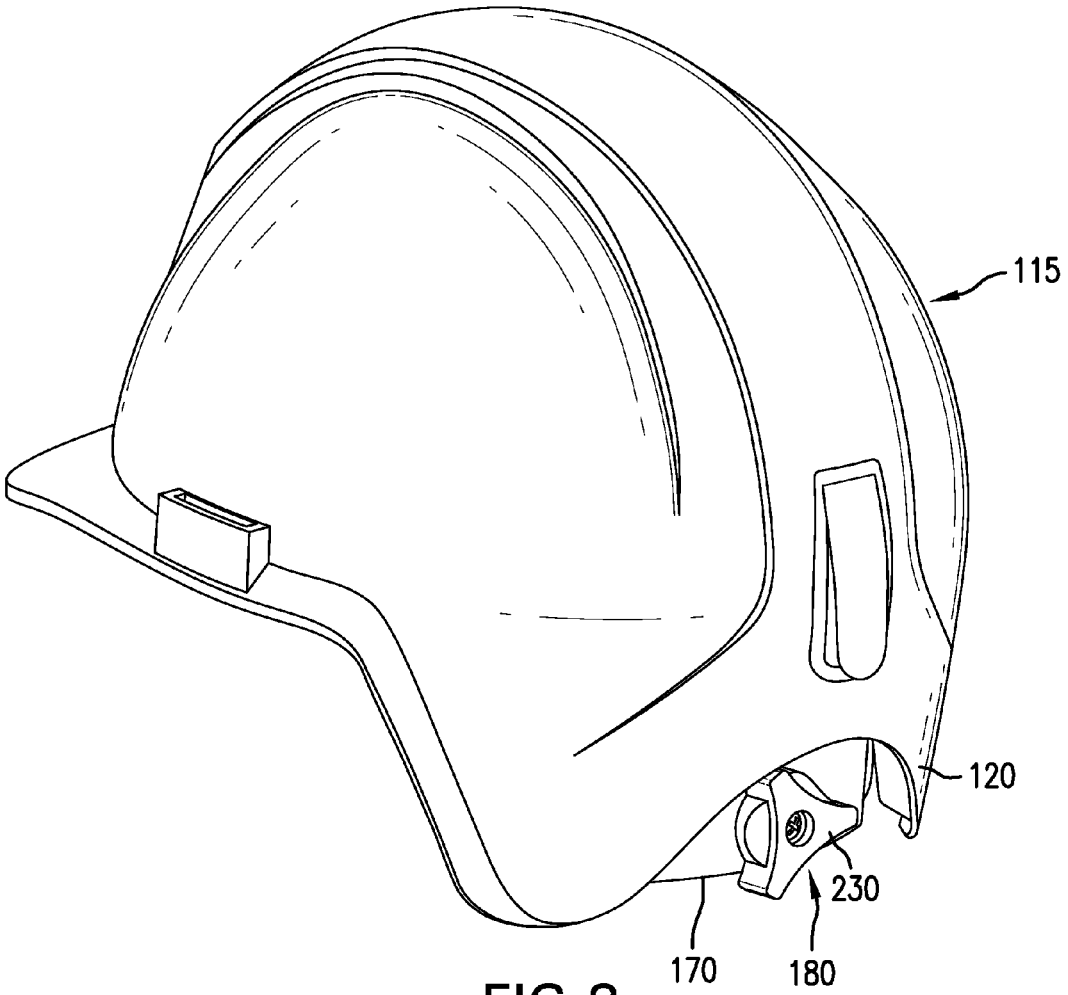
FIG. 8 depicts a rear exterior view of an exemplary protective headgear assembly.
Figure 9:
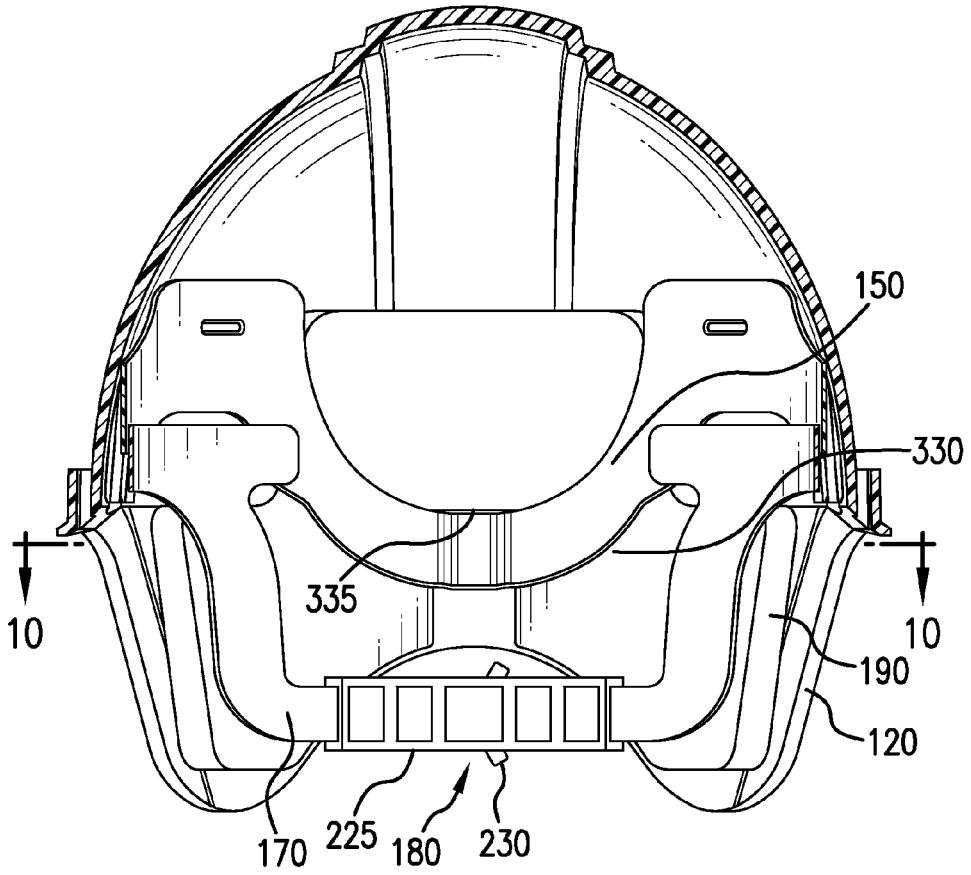
FIG. 9 depicts a rear interior view of an exemplary protective headgear assembly.
Figure 10:
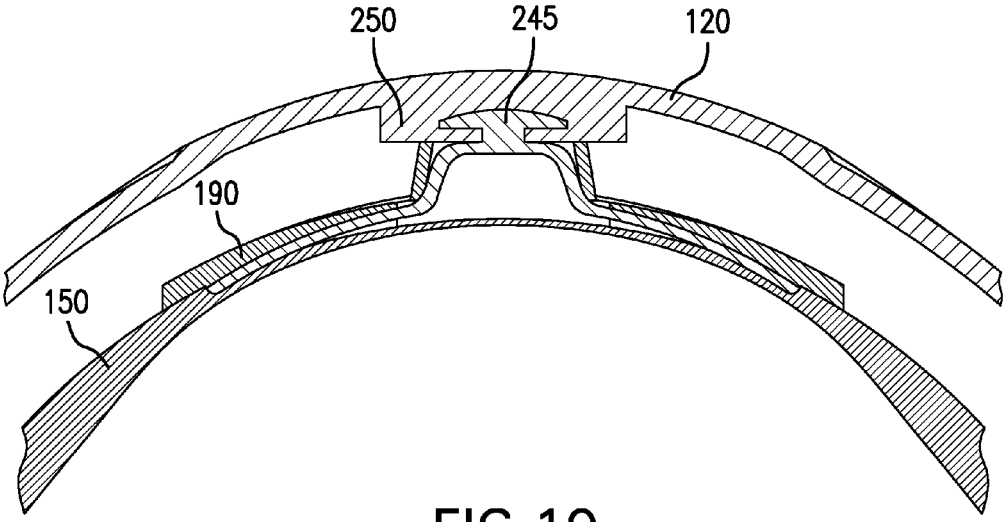
FIG. 10 depicts an exemplary sectional view taken along lines 9-9 of FIG. 9.

Then, the discussion turns to exemplify detailed embodiments of the hanger assembly and inner headband. Specifically, FIG. 5 illustrates the hanger assembly and FIG. 6-7 illustrate the inner headband. Finally, the discussion turns to a rear-impact portion and attenuator of the protective headgear assembly in FIG. 8-11 to explain improvements in protection from rear-impacts to the occipital region of a user. More specifically, FIG. 8-9 illustrate exterior and interior views of the rear-impact portion, FIG. 10 illustrates a connectivity of the rear-impact portion and the rear attenuator, and lastly with reference to FIG. 11, the rear attenuator is presented.

Figure 1:
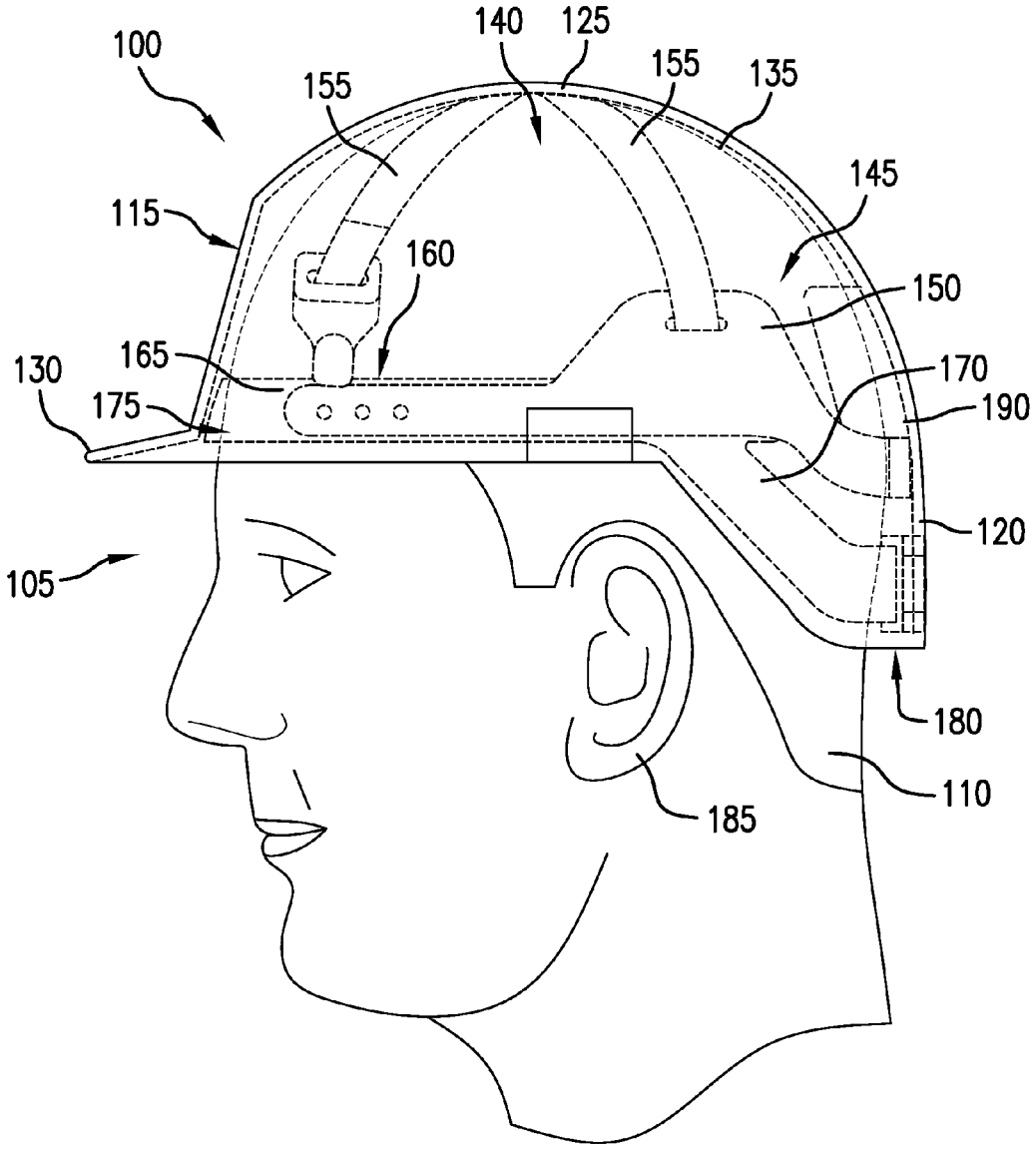
FIG. 1 depicts a side elevation view of an exemplary protective headgear assembly as worn.

FIG. 1 depicts a side elevation view of an exemplary protective headgear assembly as worn. A protective headgear assembly 100 may be worn in situations where a user requires protection of the user's head 105, such as for example construction sites, utility stations, sports games. The protective headgear assembly 100 may be constructed to comfortably accommodate many different head 105 sizes. In addition the protective headgear assembly 100 may provide protection along the occipital region 110 of the head 105 of the user. In some examples, the protective headgear assembly 100 may extend downward from the occipital region 110 to cover a portion or all of the neck of the user.

The protective headgear assembly 100 includes an outer shell 115 configured to fit on a human head 105. The outer shell 115 may be constructed of a material to be impact-resistant, such that forcible impacts to the outer shell 115 do not dent, break, or cause damage to the outer shell 115. As shown, the outer shell 115 includes a rear-impact portion 120 to provide a protective barrier to the occipital region 110 of the user. The outer shell 115 may be configured to provide Type 2 (side-impact) and/or Type 1 (top-impact) protection. The outer shell 115 also includes a dome 125 and a brim 130. As depicted, the dome 125 extends above the brim 130 for covering a cranium portion 135 of the head 105 of the user, and the rear-impact portion 120 extends below the brim 130 for covering an occipital region 110 of the head 105 of the user.

The protective headgear assembly 100 also includes a suspension system 140 for providing an interface between the head 105 of the user and the outer shell 115. The suspension system 140 includes a hanger assembly 145 connected to an inner surface of the outer shell 115. The hanger assembly 145 includes an outer headband 150 and a headstrap webbing 155. The headstrap webbing 155 extends from the outer headband 150 for receiving the cranium portion 135 of the head 105 of the user. The outer headband 150 substantially centers the head 105 of the user with the outer shell 115 via an interface with the inner headband 160.

The suspension system 140 also includes an inner headband 160 for fitting to the head 105 of a user such that the outer shell 115 may be stabilized upon the head 105 of the user. The inner headband 160 includes an adjustable front loop length 165, an adjustable occipital loop length 170, and a plurality of user controls 175, 180 for independently adjusting the front loop length 165 and the occipital loop length 170. An intersection of the front loop length 165 and the occipital loop length 170 is adapted to fit proximal a user ear 185 after fitting the inner headband 160 to the head 105 of the user via the user controls. In the depicted example, the front loop length 165 extends horizontally from the intersection and the occipital loop length 170 forms an angle with the front loop length 165 at the intersection. In some embodiments the angle formed at the intersection is approximately 135 degrees. In an exemplary embodiment, the angle formed at the intersection is approximately 150 degrees. The occipital loop length 170 is adapted to descend posterior the ear 185 of the user to cradle the occipital region 110 of the user.

The protective headgear assembly 100 also includes a rear-impact attenuator 190 to provide absorbing protection along the rear-impact portion 120 of the outer shell 115. The rear-impact attenuator 190 lines the interior side of the rear-impact portion 120. In some embodiments, the rear-impact attenuator 190 is retained in place along the interior of the lower extended portion via an interconnection of the hanger assembly 145 and the outer shell 115. In an exemplary embodiment, the rear-impact attenuator 190 may be formed via injection-molding.

Figure 2:
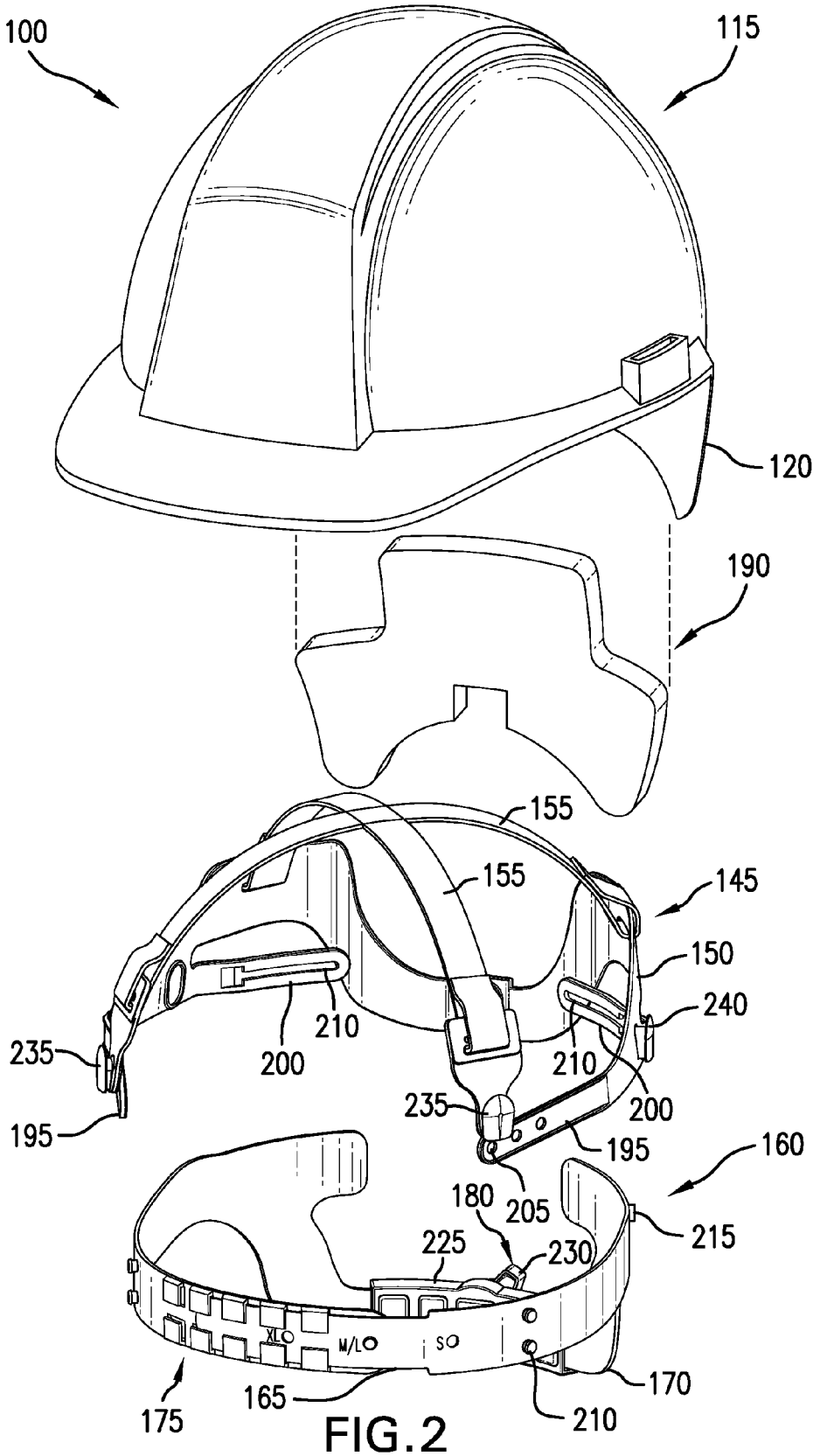
FIG. 2 depicts an exploded view of an exemplary protective headgear assembly.

FIG. 2 depicts an exploded view of an exemplary protective headgear assembly. The protective headgear assembly 100 is depicted with the suspension system 140 and the rear-impact attenuator 190 removed from the outer shell 115. In some examples, the suspension system 140 and the rear-impact attenuator 190 may be easily removed for cleaning, inspection, or adjustment, for example. In other examples, the suspension system 140 and/or the rear-impact attenuator 190 may be permanently attached to the outer shell 115.

The hanger assembly 145 may be constructed to flex inwards and outwards with the inner headband 160 such that a non-binding and conforming shape may be retained by the inner headband 160 when making slight and extreme adjustments. The hanger assembly 145 may also be formed to absorb impacts exerted upon the outer shell 115 such that the integrity of the outer shell 115 may be prolonged. In an exemplary embodiment, the inner headband 160 and the hanger assembly 145 may be flexible such as to conform to the shape of the user's head 105.

The outer headband 150 of the hanger assembly 145 includes a pair of first projections 195 and a pair of second projections 200 each extending horizontally inwards within an internal cavity of the outer shell 115. In some examples, the first projections 195 are adapted for providing a fixed attachment of the inner headband 160 to the outer headband 150. In some examples, the second projections 200 are adapted for providing a movable attachment of the inner headband 160 to the outer headband 150.

The first projections 195 each include a plurality of spaced-apart apertures 205 for receiving one or more first posts 215 of the inner headband 160, such as to fixedly attach the inner headband 160 to the outer headband 150. The second projections 200 each include an elongated slot 210 for receiving one or more second posts 220 of the inner headband 160, such as to movably attach the inner headband 160 to the outer headband 150. Each elongated slot 210 may include a wider portion to permit receiving the respective second post 220 and a narrower portion to permit slidable movement of the second post 220 within the elongated slot 210 yet restrict the second post 220 from exiting the elongated slot 210.

In an exemplary embodiment, the first projections 195 may be adapted to maintain a user-selectable horizontal separation distance between the inner headband 160 and the outer shell 115 via the fixed attachment permitted by the spaced apart apertures 205. In another illustrative embodiment, the second projections 200 may be adapted to continually center the inner headband 160 with the outer shell 115 irrespective of a diametric adjustment of the inner headband 160 via the movable attachment permitted by the elongated slot 210. For example, the user may attach the first projections 195 to the inner headband 160 such that a pre-determined separation distance is maintained between the inner headband 160 and the outer headband 150 and thus outer shell 115. During adjustment of the user controls 175, 180 of the inner headband 160, the second posts 220 may freely move along the length of the second projections 200 thus permitting the separation distance to be maintained and controlled by the attachment of the first projections 195. In some exemplary embodiments, the first projections 195 and/or the second projections 200 may be spring-loaded. For example, the projections 195, 200 may include an actuator mechanism, such as a spring, hinge, or resilient plastic connected between the respective projection 195, 200 and the outer headband 150.

In the depicted example, the first posts 215 are located at a rearward portion of the front loop length 165 and the second posts 220 are located proximate a forward portion of the occipital loop length 170 such that an intersection portion of the front loop length 165 and the occipital loop length 170 is substantially maintained in a spatial position relative the outer shell 115 by the attachment of the first posts 215 and the second post 220. In an illustrative embodiment, the intersection portion of the front loop length 165 and the occipital loop length 170 remains at a substantially fixed position relative the user ear 185 after adjustment of the inner headband 160.

The inner headband 160 is a two-piece structure which may be adjustable to a wide range of diameters such as to comfortably conform to the circumferential diameter and shape of the head 105 of different users. The inner headband 160 may provide improved adjustability, reduced distortion, and better retention to the user's head 105. In an illustrative embodiment, the front loop length 165 adjusts in length via the first user control 175. The first user control 175 is a post and aperture structure for providing macro adjustments. The occipital loop length 170 adjusts in length via the second user control 180. The second user control 180 is a ratchet assembly for providing micro adjustments. The ratchet assembly may include a ratchet case 225 for connecting to the two-piece inner headband 160 and a ratchet knob 230 for providing an operational interface for the user to adjust the diametric size of the inner headband 160.

As depicted, the headstrap webbing 155 is formed by a pair of elongated straps, each being connected to the outer headband 150 at a first end and free at an opposing end. The headstrap webbing 155 may be flexible to conform to the user's head 105 and extend across and over the cranium portion 135 of the user's head 105. In some embodiments, the headstrap webbing 155 may be adjustable in length and serve to suspend the outer shell 115 above the user's head 105 in a spaced apart manner.

Each of the straps of the headstrap webbing 155 includes a first attachment clip 235 at the free end. The attachment clips 235 secure the free end of the headstrap webbing 155 to the inner surface of the outer shell 115. Another set of attachment clips 240 are connected directly to the outer headband 150 for securing the other end of the hanger assembly 145 to the inner surface of the outer shell 115 and stabilizing the hanger assembly 145 to the outer shell 115. In some examples, the hanger assembly 145 is removably attached to the outer shell 115 in a fixed manner via the attachment clips 235, 240.

FIG. 3 depicts a bottom view of an exemplary protective headgear assembly with the inner headband in a first diametric position. In the depicted example, the occipital loop length 170 is cutaway to provide a more clear illustration of the function of the movable attachment of the second projections 200 of the outer headband 150. In the depicted example, first posts 215 are attached in a predetermined location to the apertures 205 of the first projections 195 such as to maintain a predetermined separation distance of the inner headband 160 to the inner surface of the outer shell 115. The second posts 220 are positioned within the elongated slot 210 of the second projections 200. The first user control 175 and the second user control 180 (not shown) are adjusted to a first position to reflect a first diametric size of the inner headband 160.

Also depicted is a rear attachment clip 245 extending from the rear of the outer headband 150. The rear attachment clip 245 attaches to a corresponding socket 250 of the outer shell 115 to secure the outer headband 150 to the outer shell 115. In the depicted example, the rear attachment clip 245 attaches to the socket 250 along the rear-impact portion 120 of the outer shell 115. Likewise, the first attachment clips 235 and the second attachment clips 240 also are attached to the outer shell 115 via corresponding sockets 250 of the outer shell 115. In some examples, the rear attachment clips 245 may removably attach to the sockets 250 of the outer shell 115. In other examples, the attachment clips 235, 240, 245 may permanently attach to the sockets 250 of the outer shell 115. In the depicted example, the rear attachment clip 245 secures the rear-impact attenuator 190 in place via sandwiching the rear-impact attenuator 190 between the outer headband 150 and the inner surface of the outer shell 115.

FIG. 4 depicts a bottom view of an exemplary protective headgear assembly 100 with the inner headband 160 in a second diametric position. In the depicted example, the occipital loop length 170 is cutaway to provide a more clear illustration of the function of the movable attachment of the second projections 200 of the outer headband 150. The inner headband 160 is adjusted to a second diametric position via the first user control 175 and the second user control 180 (not shown). In the depicted example, the second diametric position is smaller in size than the first diametric position.

However, in some examples, the second diametric position may be larger in size than the first diametric position.

As the diametric size of the inner headband 160 is adjusted the fixed attachment of the first projections 195 substantially prevents the intersection portion between the front loop length 165 and the occipital loop length 170 from being spatially adjusted relative the outer shell 115. The movable attachment of the second projections 200 permits the occipital loop length 170 from adjusting inwards and outwards to conform to the circumferential shape of the head 105 of the user yet works in conjunction with the fixed attachment of the first projections 195 to maintain the intersection portion between the front loop length 165 and the occipital loop length 170 from being spatially adjusted in a substantial manner relative the outer shell 115. In an illustrative embodiment, the movable attachment of the second projections 200 may also maintain the inner headband 160 substantially centered with the outer shell 115 such that the outer shell 115 centrally aligns on the user head 105 regardless of diametric size adjustment of the inner headband 160.

As shown, the second posts 220 that connect to the second projections 200 extend from a tab 255 of the inner headband 160. The tab 255 extends in a separate direction than the occipital loop length 170 and more particularly extends in a horizontal plane similar to the front loop length 165. In an illustrative example, the tab 255 is able to pivot freely during and after adjustment of the second user control 180 of the occipital loop length 170 thus limiting a movement of the second posts 220 within the elongated slot 210 of the second projections 200, thus ensuring that the intersection portion does not undergo substantial forward or rearward movement during adjustment of the occipital loop length 170 and remains substantially proximate the user ear 185.

FIG. 5 depicts an exemplary hanger assembly. The hanger assembly 145 is comprised of the outer headband 150 and the headstrap webbing 155. In an exemplary embodiment, the hanger assembly 145 may provide an interface between the inner headband 160 and the cranium portion 135 of the user head 105. The outer headband 150 includes the inwardly extending first projections 195 and the inwardly extending second projections 200 as described previously. In some examples, the outer headband 150 may include more or less first projections 195 and/or second projections 200. For example, if movable attachment is preferred near 185 the front loop length 165 as well as the occipital loop length 170, then projections similar to the second projections 200 may be located near 185 the front loop length 165. In other examples, if the outer headband 150 were being attached to another protective structure having a different shape, such as rectangular, more or less projections 195, 200 may be needed to ensure the outer headband 150 remains in a predetermined position relative the protective structure. Both the first projections 195 and the second projections 200 are able to freely pivot inwards and outwards to permit for a preferred spacing of the inner headband 160 to the outer shell 115.

As depicted in the example, the rear attachment clip 245 is located at a lower level than the second attachment clips 235, 240. In an illustrative embodiment, the rear attachment clip 245 may be secured to the outer shell 115 along the rear-impact portion 120 below the brim 130 of the outer shell 115 to secure the rear-impact attenuator 190 to the outer shell 115. The first attachment clips 235 and the second attachment clips 240 may be secured to the inner surface of the outer shell 115 above the brim 130.

Also shown with the outer headband 150 is a plurality of slots 260 spaced along the upper part of the outer headband 150. The slots 260 receive the headstrap webbing 155. In an exemplary embodiment, the headstrap webbing 155 may cross over the cranium portion 135 of the user head 105. The outer headband 150 may also include a plurality of integrated crush zones to attenuate energy impact during a top impact of the protective headgear assembly 100, thereby reducing the need for the shell to absorb energy.

FIG. 6 depicts an exemplary inner headband in a disconnected state. The inner headband 160 comprises an elongated first section 265 and an elongated second section 270 which generally mirror each other along right and left sides of the suspension assembly. The sections 265, 270 employ a curvature to improve the fit and reduce friction when the inner headband 160 is tightened. For example, each of the sections 265, 270 include a front portion 275, 280 and an occipital portion 285, 290. The front portions 275, 280 form the front loop length 165 when attached and the occipital portions 285, 290 form the occipital loop length 170 when attached.

The front portion 275 of the first section 265 includes a series of supports 295 for slidably receiving the front portion 280 of the second section 270 such that the first section 265 and the second section 270 overlap and remain aligned during and after adjustment of the front loop length 165. The front portion 280 of the second section 270 is narrower than the front portion 275 of the first section 265 to permit for being slidably received by the supports 295.

The front portion 275 of the first section 265 also includes a raised member 300 that mates with one of several apertures 305 along the front portion 280 of the second section 270 depending upon the desired macro size adjustment of the inner headband 160. In an exemplary embodiment, the front portion 280 of the second section 270 includes three equally spaced apart apertures 305. For example, a first aperture represents a large diametric size of the inner headband 160, a second aperture represents a medium diametric size of the inner headband 160, and a third aperture represents a small diametric size of the inner headband 160. In an exemplary embodiment, the user may connect the front portions 275, 280, using the raised member 300 and appropriate aperture 305 prior to placement of the protective headgear assembly 100 upon their head 105.

The occipital portions 285, 290, of the sections 265, 270, curve downwards and away from the front portions 275, 280, such that the occipital portion 285, 290 extends lower on the neck line of the user and in an exemplary embodiment along the occipital region 110 of the user. By extending along the occipital region 110 of the user, the inner headband 160 is able to provide an improved retention and supportability upon the user's head 105. Each occipital portion 285, 290, includes an elongated slot 310, 315, extending along a length of the respective occipital portion 285, 290.

Each elongated slot 310, 315 includes a gear rack to mate with an opposing occipital portion 285, 290 and collectively receive the ratchet assembly 180. When operated, the ratchet assembly 180 may cause the occipital portions 285, 290 to move towards or away from each other depending on directional movement of the ratchet assembly 180, such that the diameter of the inner headband 160 may be lessened or increased. In some embodiments, the occipital portions 285, 290 may have a curvature as shown that is effective to reduce the distortion in the inner headband 160 and extend below the rear-impact portion 120 of the outer shell 115.

In an exemplary embodiment, the user may first adjust the relative positions of the front portions 275, 280, to a medium setting to provide a macro diametric adjustment of the inner headband 160. The user may then place the protective headgear assembly 100 upon their head 105 and operates the ratchet assembly 180 to adjust the relative positions of the occipital portions 285, 290 to provide a fine-tuned or micro diametric adjustment of the inner headband 160 until the inner headband 160 conforms comfortably to the head 105 of the user. If the inner headband 160 is too large to be sufficiently tightened with the ratchet assembly 180, the protective headgear assembly 100 may be removed and the macro position may be changed to a smaller setting. Alternatively, if the inner headband 160 is not large enough to fit the user's head 105 comfortably after adjustment of the micro position, the protective headgear assembly 100 may be removed and the macro position may be changed to a larger setting. By adjusting relative positions of both the front portions 275, 280 and the occipital portions 285, 290 of the inner headband 160, a preferred shape (E.g., circular) of the inner headband 160 may be better retained and a relative concentric position of the inner headband 160 with the center of gravity of the outer shell 115 may be retained thus ensuring that the protective headgear assembly 100 rests properly and comfortably upon the head 105 of the user.

Also shown along the inner headband 160 directly rearward of the front portion are the first posts 215. The first posts 215 are attached to the first projections 195 of the outer headband 150 to regulate a separation distance of the inner headband 160 to the outer shell 115. As depicted, the inner headband 160 may include a series of first posts 215 vertically spaced along the inner headband 160. In an exemplary embodiment, a predetermined one of the first posts 215 may be attached to the predetermined aperture 205 of the first projection 195 depending upon the relative height of the inner headband 160 to the brim 130 of the outer shell 115 that is preferred. For example, if the lower of the first posts 215 is attached to the first projection 195, the inner headband 160 will be supported in a higher position relative the brim 130 of the outer shell 115. In this way, the position of the inner headband 160 as it relates to the shape of the user's head 105 can be adjusted. The brim 130 and outer shell 115 may have a height based upon the length of one or more crown straps of the headstrap webbing 155.

Each section of the inner headband 160 also includes a tab 255 extending from intersection portions 320, 325 of the first section 265 and the second section 270. The intersection portions 320, 325 are located at an intersection of the front portions 275, 280 and the occipital portions 285, 290 of the sections 265, 270. The tab 255 extends horizontally from the intersection portion 320, 325 in a rearward direction away from the respective front portion 275, 280. As shown, each tab 255 includes upper and lower second posts 220 for connecting to the second projections 200 of the outer headband 150. Like the upper and lower first posts 215, the selection of the upper and lower second posts 220 may depend upon what height that the user prefers the outer shell 115 to rest relative their head 105.

FIG. 7 depicts an exemplary inner headband in a connected state. The sections 265, 270 are attached via connection of the front portions 275, 280 of the first section 265 and the second section 270. As exemplary illustrated, the front portion of the second section 270 may be comprised of a lesser width than the front portion 275 of the first section 265 such that the front portion of the second section 270 may be received by the supports 295 of the first section 265 when the front portions 275, 280 overlap.

FIG. 8 depicts a rear exterior view of an exemplary protective headgear assembly. The rear-impact portion 120 extends downwardly from the outer shell 115. The rear-impact portion 120 may extend downwards to cover the occipital region 110 of the user in some examples. In other examples, the rear-impact portion 120 may extend further downwards to cover a nape region of the user. In the depicted example, the rear-impact portion 120 forms a concave shape to permit accessibility to the second user control 180. As illustrated, the second user control 180 includes a ratchet knob 230 connected to the occipital loop length 170 of the inner headband 160.

FIG. 9 depicts a rear interior view of an exemplary protective headgear assembly. The rear-impact attenuator 190 is sandwiched between the outer headband 150 of the hanger assembly 145 and the rear-impact portion 120 of the outer shell 115. The downwardly extending portion of the outer headband 150 also extends across a center of the rear-impact attenuator 190 to ensure stability of the rear-impact attenuator 190 and provide a secure connection. In the depicted example, the attenuator 190 includes a channel 330 following the outer headband 150 which the outer headband 150 is nested within and an opening 335 for the rear attachment clip 245 of the outer headband 150 to extend through and connect to the mating socket 250. In an exemplary embodiment, no additional fasteners or adhesive are required to secure the rear-impact attenuator 190 in place against the lower extended portion except the rear attachment clip 245 and mating socket 250. As shown, the second user control 180 extends below the attenuator 190 to permit accessibility by the user.

FIG. 10 depicts an exemplary sectional view taken along lines 9-9 of FIG. 9. The rear attachment clip 245 of the outer headband 150 is shown as extending through the opening 335 of the rear-impact attenuator 190 and being received within the rear socket 250 of the outer shell 115 to securely retain the rear-impact attenuator 190 in place with respect to the outer shell 115 and outer headband 150 of the hanger assembly 145. As shown the rear-impact attenuator 190 is curved inwardly. Various portions of the rear-impact attenuator 190 may include increased padding or absorption capabilities depending upon a required head 105 protection standard or preference.

Figure 11:
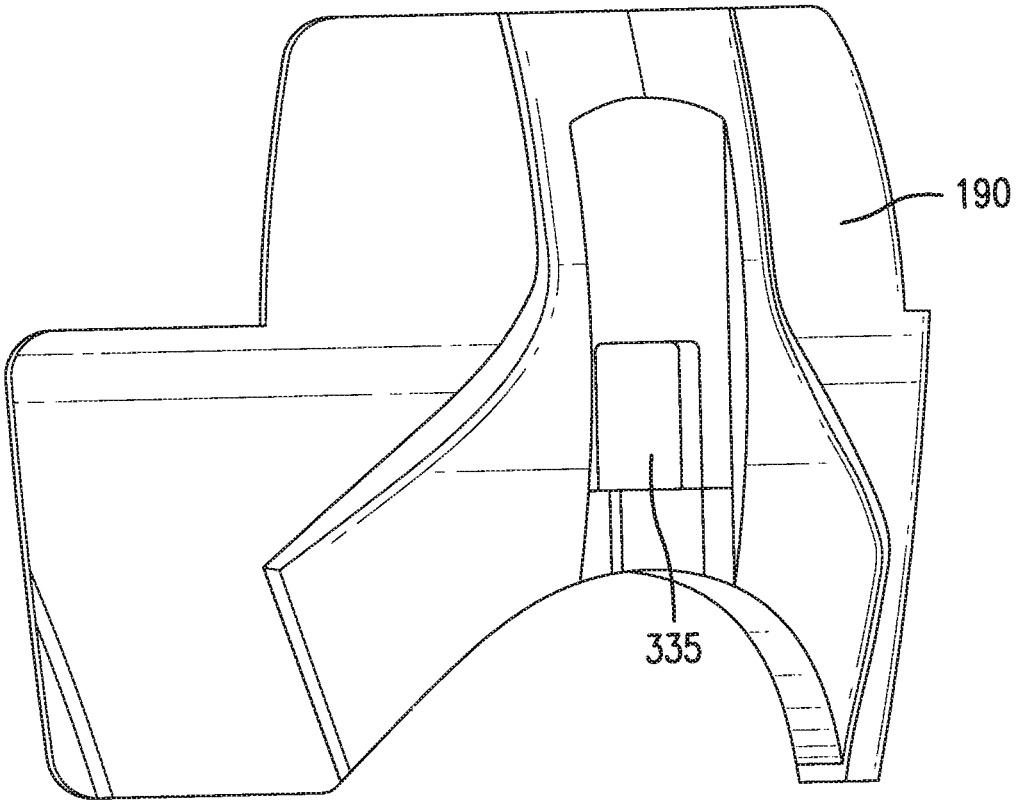
FIG. 11 depicts an exemplary rear-impact attenuator.

FIG. 11 depicts an exemplary rear-impact attenuator. The rear-impact attenuator 190 provides impact protection and absorption for impacts to the outer shell 115 adjacent the rear-impact attenuator 190. In an exemplary embodiment, the rear-impact attenuator 190 is sized and shaped to be positioned and conform to the rear-impact portion 120 along an interior surface of the rear-impact portion 120. The attenuator 190 includes a concave lower edge to align with the concave edge of the rear-impact portion 120. The opening 335 extends through the attenuator 190 for receiving the rear attachment clip 245 of the outer headband 150.

In an exemplary embodiment, the rear-impact attenuator 190 may be comprised of an absorbent material, such as expanded polystyrene or plastic to absorb impacts to the outer shell 115. The rear-impact attenuator 190 may be comprised of a width suitable for absorption of energy imparted upon the outer shell 115 by an external force. In some embodiments, additional attenuators may be used and secured in place around different portions of the outer shell 115. For example, a side-impact attenuator may be used on one or more sides of the outer shell 115. In another example, a front-impact attenuator may be used along the front of the outer shell 115.

Although various embodiments have been described with reference to the Figures, other embodiments are possible. For example, an impact-resistance outer shell may be configured to fit on a human head and a suspension system may operatively attach to the outer shell. The suspension system may have a two-piece inner headband adapted for diametric adjustment around the human head and a hanger assembly to provide a linkage between the inner headband and the outer shell. The suspension system may also have headstrap webbing extending from the hanger assembly along an interior of the outer shell to directly receive the head. The inner headband may include first and second user controls for providing macro and micro adjustments to the diameter of the inner headband and the hanger assembly may include movable attachment projections connecting the inner headband to the hanger assembly such that a substantially concentric position of the inner headband relative the outer shell is retained after diametric adjustment of the inner headband along either of the first or second user controls.

In an exemplary embodiment, the outer shell may include a rear-impact portion to provide a protective barrier; the rear-impact portion extends below a brim of the outer shell. For example, the rear-impact portion may extend downwardly from a rear of the outer shell. In another example, the rear-impact portion may extend downwardly from a side of the outer shell. In an exemplary embodiment, a rear-impact attenuator may line at least a portion of the rear-impact portion. For example, the rear-impact attenuator may be secured along an interior surface of the rear-impact portion by the hanger assembly. In some exemplary embodiments, the rear-impact portion may be movable or fixed relative the outer shell. The rear-impact portion may be flat, curved, or square-indent shaped along the lower edge of the rear-impact portion.

In an exemplary embodiment, rear-impact portion may extend downwards from one or more sides of the outer shell to protect a side of the user's head, face, and/or neck. The rear-impact portion may extend over a user's ear or may include a recessed portion or opening to accommodate the user's ear, for example. In some examples the rear-impact portion may extend from the sides and rear of the outer shell to provide a maximum amount of protection to the user. In other embodiments, a front-impact portion may be included to protect a user's face. The front-impact portion may include eye openings or integral transparent lenses. In some embodiments, the rear-impact portion(s) may be integral with the outer shell such as to be fixed with respect to the outer shell. In some embodiments, the rear-impact portion(s) may be removable from the outer shell such that one or more rear-impact portions may be removed or detached when use is not necessary.

In an exemplary embodiment, the outer shell including the rear-impact portion is formed of injection-molded plastic parts. For example, the design of the outer shell is such that a mold with several collapsing cores may be required to form the detail of the rear-impact protection portion, in addition to the sockets required to attach the hanger assembly.

In accordance with another exemplary embodiment, the inner headband may have a first section and a second section operatively attached along both a front and a rear of the section. For example, the first user control providing macro adjustment may be located at the front of the sections. The second user control providing micro adjustment may be located at the rear of the sections. In an exemplary embodiment, a ratcheting assembly may be used to provide operative adjustment of the inner headband.

In accordance with another embodiment, alternate mechanisms may be used to attach the occipital portions of the sections together and provide micro adjustment rather than the ratchet assembly. For example, a slotted attachment with a hand operable fastener may be used for adjusting the relative position of the sections. In another example, an electronic device may output a signal to a mechanical actuator for providing automatic or controlled adjustment. In another example, an adjustment system may be used which automatically or upon manual direction causes both macro and micro adjustment systems to adjust simultaneously or consecutively.

In an exemplary embodiment, the attachment projections of the outer headband may pivot inwardly within a horizontal plane to ensure retention of the shape of the inner headband during diametric adjustment. The attachment projections may provide a spring force upon the inner headband. The plurality of projections may each provide a spring force of substantially equal value. The direction of the spring force of each projection may be inward toward the inner headband. These spring forces may promote the centering of the headgear upon the user's head, for example. The hanger assembly may include a plurality of integral impact absorbing portions spaced along a length of the hanger assembly for absorbing received energy caused by an impact to the outer shell. For example, an external force applied to the top of the outer shell may cause the hanger assembly to partially collapse in a controlled and even manner due to the impact absorbing portions or crush zones.

In accordance with another embodiment, outer shell may be formed in various helmet shapes. For example, the outer shell may be formed in the shape of a football helmet. In another example, the outer shell may be formed in the shape of a baseball helmet. In another embodiment, the outer shell may be formed in the shape of a vehicle helmet, such as for example an automobile, ATV, or snowmobile helmet. In accordance with another embodiment, the headgear protection assembly may include a chin strap for retaining the headgear protection assembly securely on the head of the user. In some examples, the outer shell may include a plurality of reinforcing ribs to add strength and rigidity to the outer shell.

In accordance with an exemplary embodiment, headgear protection assembly may include sensors to communicate whether the headgear protection assembly is properly positioned upon the user's head. For example, proximity or weight sensors may monitor and communicate a center of gravity position of the headgear protection assembly relative a center of the user's head.

In another example, sensors may monitor and communicate a position of the inner headband relative the user's head to ensure that the inner headband on the proper macro or micro adjustment setting. For example, a proximity sensor may monitor how close multiple portions of the inner headband are to the user's head. In another example, sensors may monitor a pressure placed upon the user's head by the inner headband to determine whether the inner headband should be loosened or tightened. In some examples, various sensors may communicate with each other to calculate a compromised position of the headgear protection assembly upon the user's head. For example, a sensor used for determining optimal position relative a center of gravity of the outer shell and a sensor used for determining optimal diametric adjustment of the inner headband may communicate to determine optimal collaborative placement and adjustment of the headgear protection assembly relative the specific head size of the user.

In another example, the headgear protection assembly may include a memory and processor for receiving diametric values of a user's head and calculating or retrieving from memory an optimal adjustment position of the inner headband. The memory may include a database of diametric head sizes each which correlate with a specific macro and/or micro adjustment position.

In accordance with another embodiment, the outer shell may include sensors to monitor and communicate a structural integrity of the outer shell. For example, the outer shell may be weakened due to impact with a substantial external force. The sensor would realize the weakness of the outer shell and recommend to the user that the outer shell be replaced, for example. The sensor may communicate to the user in various manners, such as via a display for example. In other examples, the sensor may communicate via audible or tangible signals. In other examples, the sensor may propagate signals to an external receiver or control center.

In some embodiments, components of the headgear protection assembly may include electrical shock protection. For example, the outer shell may be insulated to provide a resistive barrier from current flow.

In various embodiments, the micro and macro adjustments described herein may be configured upon first use, for example. In various examples, the various controls may be manipulated to maintain the inner headband substantially centrally disposes with respect to the outer shell, which may advantageously improve protection for the wearer relative to an inner headband that is off-center and/or misshapen. In various examples, the shape of the inner headband may be maintained substantially well conformed to the user's head, and/or the centrally located inner headband within the outer shell may be substantially maintained over a wide range of head sizes with a single headgear assembly.

In some exemplary embodiments, a sizing chart may be employed for the protective headgear assembly. For example, a plurality of vertical bars may illustrate a population sampling of head circumference and representative shapes may indicate respective macro adjustment sizes of the inner headband along the front end which accommodate each of the sampled circumferences. In operation, for a user to quickly select the appropriate macro adjustment of the inner headband, the user may measure the circumference of their head and using the chart find the appropriate size (small, medium, or large) that fits with the measured circumference. In some instances, there is overlap between different macro adjustment sizes, where either size adjustment may accommodate the respective circumference.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A protective headgear assembly, comprising:

an outer shell having a defined bottom opening and an internal cavity configured to fit over a cranium portion of a head of a user, said outer shell being formed of a rigid, protective material;

a hanger assembly connected to an inner surface of said outer shell, wherein said hanger assembly includes an outer headband and a headstrap webbing, wherein said headstrap webbing extends from said outer headband adapted for receiving the cranium portion of the head of the user, wherein said outer headband has one or more first projections and has one or more second projections each extending horizontally inwards within said internal cavity, wherein said first projections are adapted for providing a fixed attachment and wherein said second projections are adapted for providing a movable attachment; and an inner headband adapted for fitting to the head of a user such that said outer shell is stabilized upon the head of the user, wherein said inner headband is connected to said first projections and said second projections of said outer headband, wherein said inner headband fixedly attaches to said first projections, wherein said first projections are adapted to maintain a user-selectable horizontal separation distance between said inner headband and said outer shell, wherein said inner headband slidably attaches to said second projections, wherein said second projections are adapted to center said inner headband within said outer shell irrespective of a diametric adjustment of said inner headband, and wherein said inner headband includes an adjustable front loop length, an adjustable occipital loop length, and a plurality of user controls for independently adjusting said front loop length and said occipital loop length, wherein an intersection of said front loop length and said occipital loop length is adapted to fit proximal a user ear after fitting said inner headband to the head of the user via said plurality of user controls, wherein said front loop length extends horizontally from said intersection, wherein said occipital loop length forms a non-zero angle with said front loop length at said intersection, and wherein said occipital loop length is adapted to descend posterior the ear of the user to cradle an occipital of the user.

2. The protective headgear assembly of claim 1, wherein said plurality of user controls include a macro adjustment along said front loop length and a micro adjustment along said occipital loop length.

3. The protective headgear assembly of claim 1, wherein said inner headband is comprised of a separable two-piece structure.

4. The protective headgear assembly of claim 1, wherein said first projections each include a plurality of spaced-apart apertures and wherein said second projections each include an elongated slot.

5. The protective headgear assembly of claim 1, wherein said outer shell includes a brim, a dome, and a rear-impact portion, wherein said dome extends above said brim adapted for covering the cranium portion of the user, and wherein said rear-impact portion extends below said brim adapted for covering a nape region of the user.

6. The protective headgear assembly of claim 5, further comprising a rear-impact attenuator lining said rear-impact portion.

7. The protective headgear assembly of claim 1, wherein said first and said second projections are configured to provide a centering force directed inward and received by said inner headband.

* * * * *